US007222664B2

(12) United States Patent
Bouzon et al.

(10) Patent No.: US 7,222,664 B2
(45) Date of Patent: May 29, 2007

(54) HEAT EXCHANGER PLATE AND THIS EXCHANGER

(75) Inventors: Christophe Bouzon, Sautveterre (FR); Jean-Antoine Gruss, Seyssinet (FR)

(73) Assignee: Commissariat A l'Energie Atomique, Paris (FR)

( * ) Notice: Subject to any disclaimer, the term of this patent is extended or adjusted under 35 U.S.C. 154(b) by 34 days.

(21) Appl. No.: 10/991,481

(22) Filed: Nov. 19, 2004

(65) Prior Publication Data

US 2006/0016587 A1 Jan. 26, 2006

(30) Foreign Application Priority Data

Nov. 20, 2003 (FR) ..... 03 50865

(51) Int. Cl.
*F28D 7/16* (2006.01)

(52) U.S. Cl. ..... 165/165; 165/177; 165/183

(58) Field of Classification Search ..... 165/165, 165/168, 177, 183; 135/115
See application file for complete search history.

(56) References Cited

U.S. PATENT DOCUMENTS 3,841,938 A * 10/1974 Grosse-Holling et al. ... 165/175
4,270,596 A * 6/1981 Zinn et al. ..... 165/171
4,740,344 A * 4/1988 Wollbeck et al. ..... 165/148
4,934,455 A * 6/1990 Hasegawa ..... 165/166
5,036,909 A * 8/1991 Whitehead et al. ..... 165/133
5,775,410 A * 7/1998 Ramm-Schmidt et al. .. 165/110
6,787,116 B2 * 9/2004 Williams et al. ..... 165/148
2003/0070793 A1 4/2003 Dierbeck
2004/0079521 A1 * 4/2004 Torigoe et al. ..... 165/166

FOREIGN PATENT DOCUMENTS

DE 413 505 5/1925
DE 296 04 521 U1 8/1996
EP 0 168 637 A2 1/1986

* cited by examiner

*Primary Examiner*—Teresa J. Walberg
(74) *Attorney, Agent, or Firm*—Oblon, Spivak, McClelland, Maier & Neustadt, P.C.

(57) ABSTRACT

The heat exchanger plates have the section shown, with raised sections on the upper and lower faces in which run the flow pipes of one of the fluids. Notches are created on the longitudinal ends to allow these pipes to communicate, their supply and evacuation from a lateral face of the plate, whereas the other fluid enters and leaves via the longitudinal faces. The exchanger is therefore easier to make. The plates are manufactured by extrusions and only machined to create the notches.

10 Claims, 5 Drawing Sheets

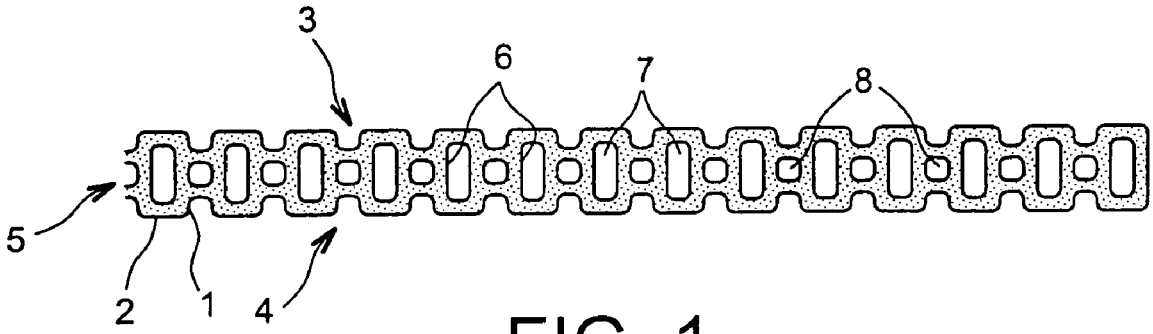
FIG. 1
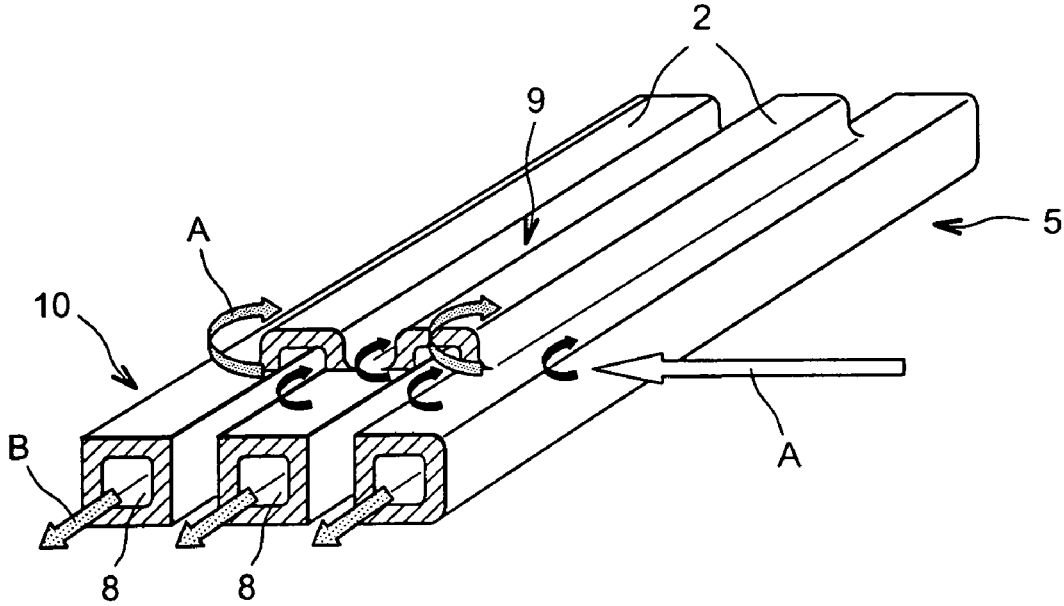
FIG. 2
FIG. 3
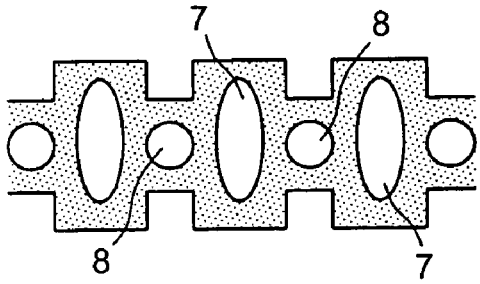

FIG. 4
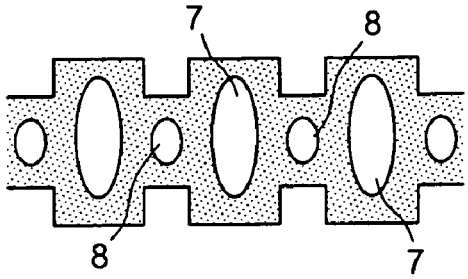
FIG. 5
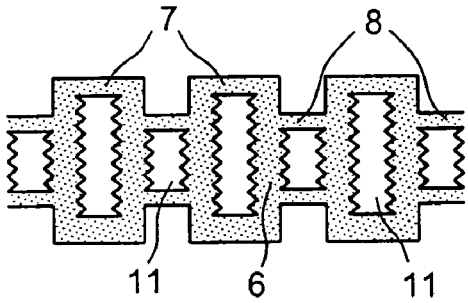
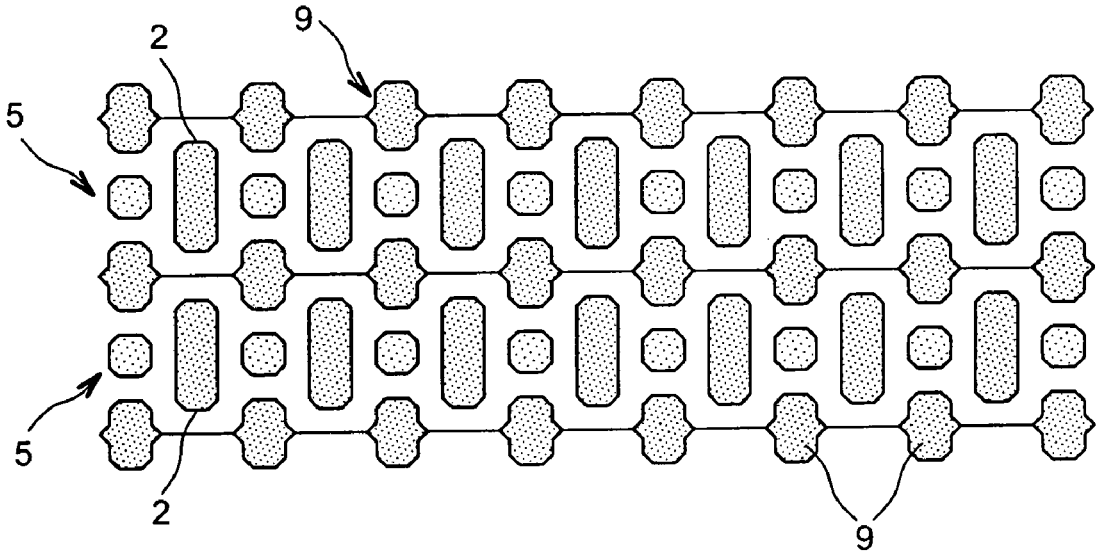
FIG. 6

HEAT EXCHANGER PLATE AND THIS EXCHANGER

FIELD OF THE INVENTION

This invention relates to a heat exchanger plate, as well as a heat exchanger comprising at least one of these plates.

DISCUSSION OF THE BACKGROUND

Heat exchangers are commonly used in several technical fields, such as transports, air conditioning, thermal work or fuel cells. Many families also exist if we consider their structure, or the way in which the pipes for transporting the fluids are constructed and positioned. The heat exchangers of which the invention is part comprises plates in which the fluid transport pipes are encased. Such a structure offers the advantages of being compact while maintaining good mechanical resistance, in particular with respect to fluids at high pressure. A recent example is described in the document U.S. Pat. No. 6,467,535 B1, where the plates comprise an external envelope defining a volume which walls, one part with the envelope, divide into flow pipes for the two fluids. Such plates may be made from a single piece by an extrusion process which, conjointly with an adequate thickness of the envelope and the walls, ensures the desired level of resistance.

However, connecting the plate pipes still causes some problems. As the pipes are parallel and adjacent, the channels which take the two fluids to and from the exchanger must be also, alternating on the width of the plate, which creates constraints as assembly is difficult and the channels must also withstand the fluid pressures, whereas it is unlikely that it is possible to construct with the same resistance as the pipes. The connections thus become the weak points of the heat exchanger, and it is not possible to reinforce them.

SUMMARY OF THE INVENTION

This is why the invention has been devised: it first concerns a heat exchanger plate with a particular form, that is suited to connections by simple means.

In its general form, the heat exchanger plate comprises an external envelope and walls dividing a volume defined by the envelope of the pipes, characterised in that the envelope has raised sections, the raised sections and the pipes running in a same longitudinal direction, a first category of the pipes running into the raised sections, and the raised sections and the envelope are notched on part of it in the longitudinal direction opening the pipes of the first category.

The raised sections may be established on two opposite sides of the envelope.

The heat exchanger comprises at least one of these plates in a stack, as well as a frame surrounding the stack and inlet and outlet channels for the fluid traversing the frame and communicating with the pipes, and it is remarkable in that the channels comprise on the one hand channels communicating with the pipes of the first category and running from a first side of the frame, and on the other hand channels communicating with a second category of pipes (separated from the first pipes by walls and transporting the other fluid) and running from a second side of the frame that is different from the first. Typically, the frame comprises four sides in the form of a rectangle, the first and second side of which mentioned, which are perpendicular to one another; the two remaining sides, or one of them, may comprise other inlet and outlet channels for the fluid or connection channels between two plates. The frame may also be simply composed of two independent parts at the ends of the channels.

In this case the lateral tightness of the plates is carried out by assembling the raised sections of its lateral ends.

The fundamental advantage of the invention is that the inlet and outlet channels of the two fluids are not intertwined nor adjacent, but are separated, the channels leading to the pipes running in the raised sections placed on a lateral side of the plate, and the channels leading to the other pipes are placed on a longitudinal end edge of the plate.

The pipes of the two categories may have different forms, but it is advantageous for a least those of the first category to have an oblong section, those of the second category having a more regular section.

The exchange surface is increased if the pipes have limiting surfaces that are grooved longitudinally.

The plates are advantageously made by extrusion.

BRIEF DESCRIPTION OF THE DRAWINGS

The invention will now be described with reference to the figures, of which:

FIGS. 1 and 2 illustrate a first embodiment of the invention,

FIGS. 3, 4 and 5 represent certain possible variants of the first embodiment, FIGS. 6 and 7 represent two views of a plate stack, FIGS. 8 and 9 two embodiments of heat exchanger.

DETAILED DESCRIPTION OF THE PREFERRED EMBODIMENTS

Figure 7:
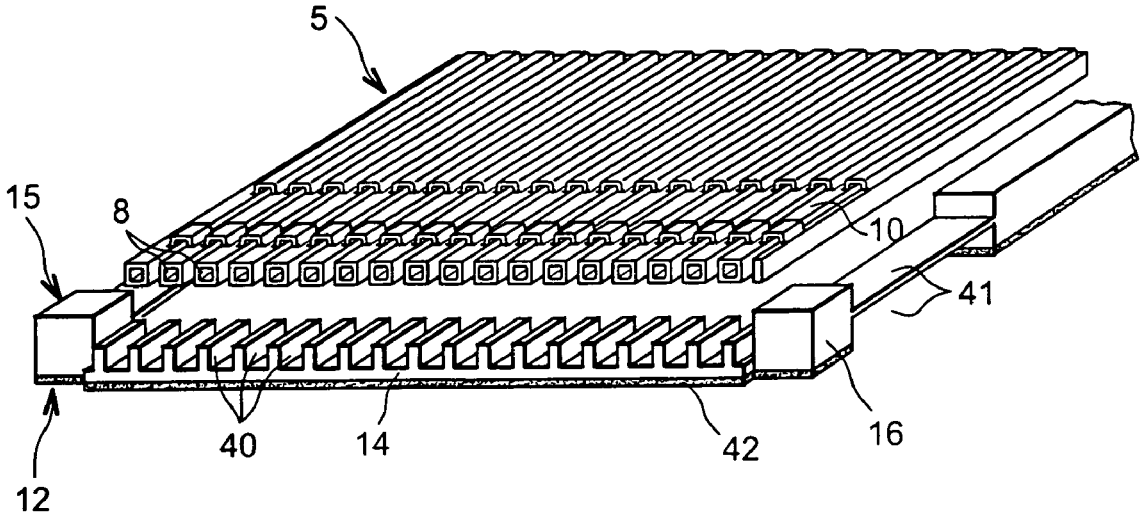

A heat exchanger plate in accordance with the invention has the section shown in FIG. 1, with an external envelope 1 comprising periodic raised sections 2 protruding from two main faces 3 and 4 and opposed to this plate 5 and which run in a longitudinal direction; the plate 5 further comprises walls 6 running from one face 3 to the other 4 vertically under the raised sections 2, and also running in the longitudinal direction. These walls 6 limit the pipes 7 and 8, of which those of a first category 7 run under the raised sections 2 and in them, and those of a second category 8 run between the raised sections 2 alternating with the previous ones. The pipes of the first category 7 have a more or less rectangular or oblong section, and those of the second category 8 a more regularly-dimensioned section.

It is provided that the raised sections 2 are cut or notched, at least on part of the length of the plate 5 so as to open laterally the pipes of the first category 7. FIG. 2 illustrates by the arrows A that a fluid introduced on the plate 5 runs, via the notch 10 thus formed, in all of the pipes of the first category 7, and also, on the pipes of the second category 8, in the pipes of the third category 9 running between the raised sections 2. One of the heat exchange fluids will effectively follow these routes and the other will flow in the pipes of the second category 8 according to the arrows B. As the notch 10 does not reach the pipes of the second category 8, the fluids remain separated.

We have shown the pipes 7 and 8 to be more or less rectangular; other sections would be possible, as shown by FIGS. 3 and 4 which illustrate elliptic pipes of the first category 7 and pipes of the second category 8 respectively circular and elliptic; another type of layout is that shown in FIGS. 5, which shows that the pipes 7 and 8 may have walls limiting them with longitudinal micro-grooves 11 providing them with a serrated section that increase the heat exchange surface between the fluids. This layout will therefore be adopted above all on the lateral walls, which are the faces of the walls 6.

FIGS. 6 and 7 represent a stack of plates 5, the raised sections 2 of the plates 5 stacked being a mutual support and also closing the sections of the pipes of the third category 9. The exchanger may be completed by a frame 12 assembled around the stack of plates 5 (which also comprises two end plates, solid, not shown). The frame 12 has four sides in the form of a rectangle, and is adjusted around the plates 5 by connecting to the pipes 7 and 8. It is composed of elementary frames 15 that are at least equal in height to the plates 5, which they respectively surround and which are stacked like them. The pipes 8 of the second category are cleared by means of machining beyond the notch 10 and are adjusted in the serrations 40 machined in a first side 14 of the elementary frames 15. A second side 16 of the elementary frames 15, adjacent to the previous one, has orifices 41 in it aligned with the notch 10. It can be remarked that the heat exchange is carried out by all sides of the pipes 8 of the second category, towards the pipes 7 and 9 of the first and third category which surround it almost completely, and that it is consequently very good.

The tightness and cohesion of the heat exchanger are ensured by brazing or gluing 42 between the elementary frames 15. The tightness may also be carried out by welding around the edges. The addition of sealing linings is not necessary elsewhere.

Figure 8:
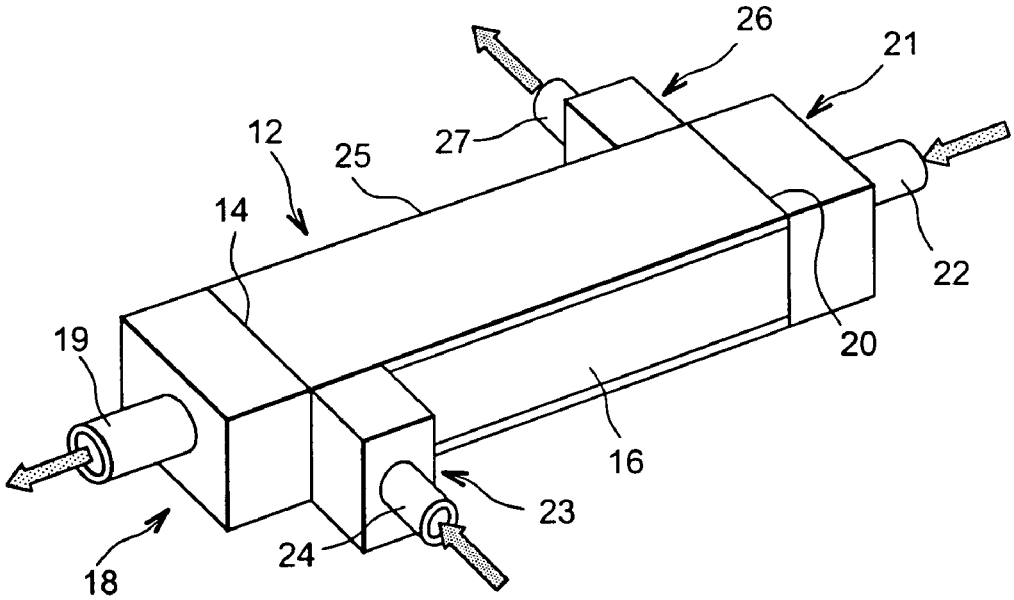

The assembly is completed by distributors such as that of FIG. 8. The first side 14 receives an outlet distributor 18 of the second fluid and joins the pipes of the second category 8 with an outlet channel 19. A third side 20 of the frame 12, on the opposite side to the first and connected to the pipes of the second category 8 in the same way, receives a distributor 21 similar to the previous one and comprising an inlet channel 22 of the second fluid. The second side 16 of the frame 12 receives a third distributor 23, which is an inlet distributor of the first fluid and joins an inlet channel 24 to the orifices 41, to the notches 10 and to the pipes of the first and third category 7 and 9. Finally, a fourth side 25 of the frame 12 receives an outlet distributor 26 of the first fluid equipped with a channel 27; this distributor 26 is at the opposed longitudinal end to the previous distributor 23 of the plate stack 5; the distributors 23 and 26, and their connections and communications, are similar.

Figure 9:
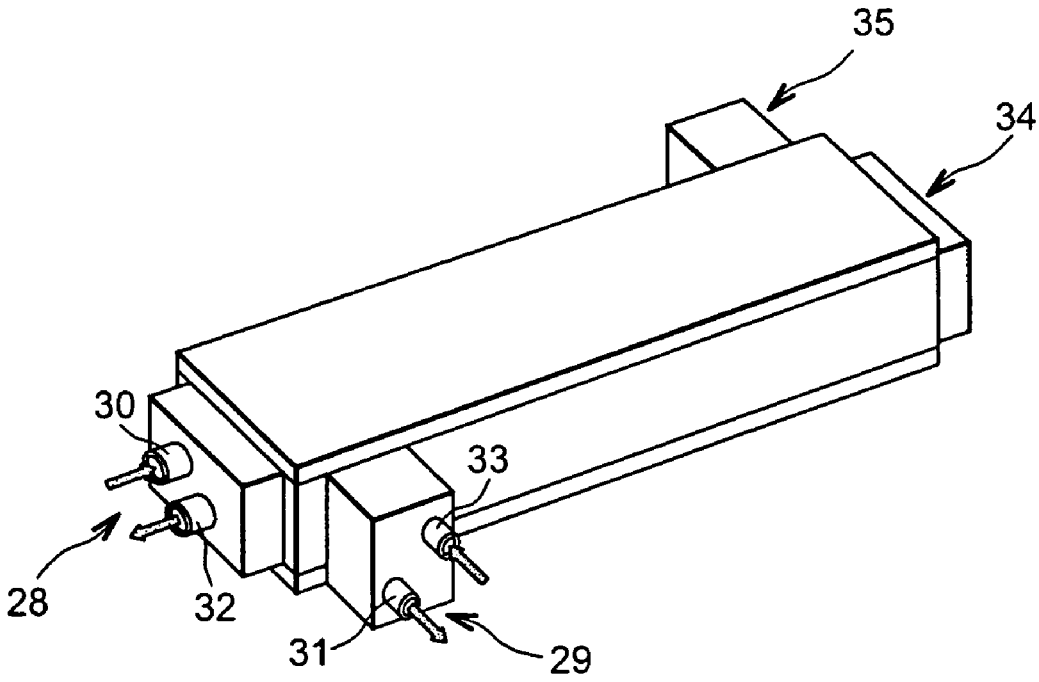

This device authorises a counter-flow in the heat exchanger. A co-current flow configuration is also possible. Other reasons are obviously possible, and one of them is represented in FIG. 9, where the distributors 18 and 23 are replaced by the distributors 28 and 29 each having an inlet channel 30 or 31 and an outlet channel 32 or 33 each of which communicates with a respective portion of the distributor and to a respective group of the plates 5 and pipes. The other distributors 21 and 26 are replaced by blind boxes 34 and 35 which authorise the passage of the respective fluid of one of the groups of plates 5 and pipes to the other group. This device therefore permits multi-pass flow configurations for each of the two fluids. Two groups of plates 5 and pipes must obviously be separated by a continuous plate.

Figure 10:
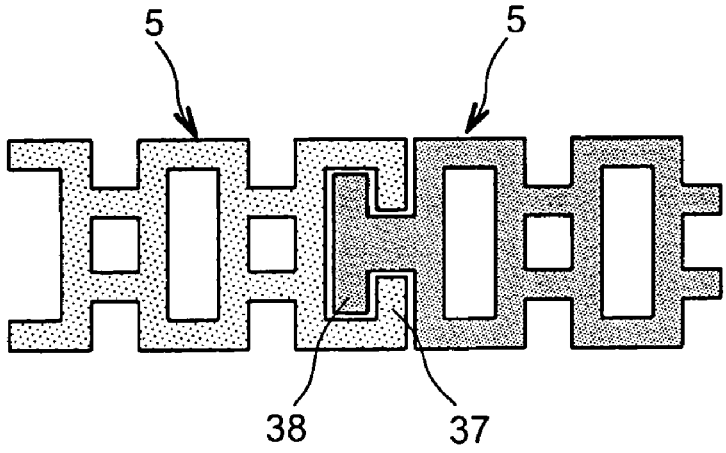
FIG. 10 shows a possible embodiment of plate assemblies.

Les plates 5 may be made by an extrusion process using a suitable material, metal or polymer, which provides them with a one piece structure with a uniform section, then simple machining is carried out to create the notches 10. It is possible to leave stops 36 in order to prevent the plates 5 from travelling too far down the longitudinal ends of the frame 12. We must also mention the possibility, shown in FIG. 10, of making the ends of the plates 5 in the transversal direction with complementary forms 37 and 38, to permit end to end assembly which creates a resulting plate that is wider.

Figure 11:
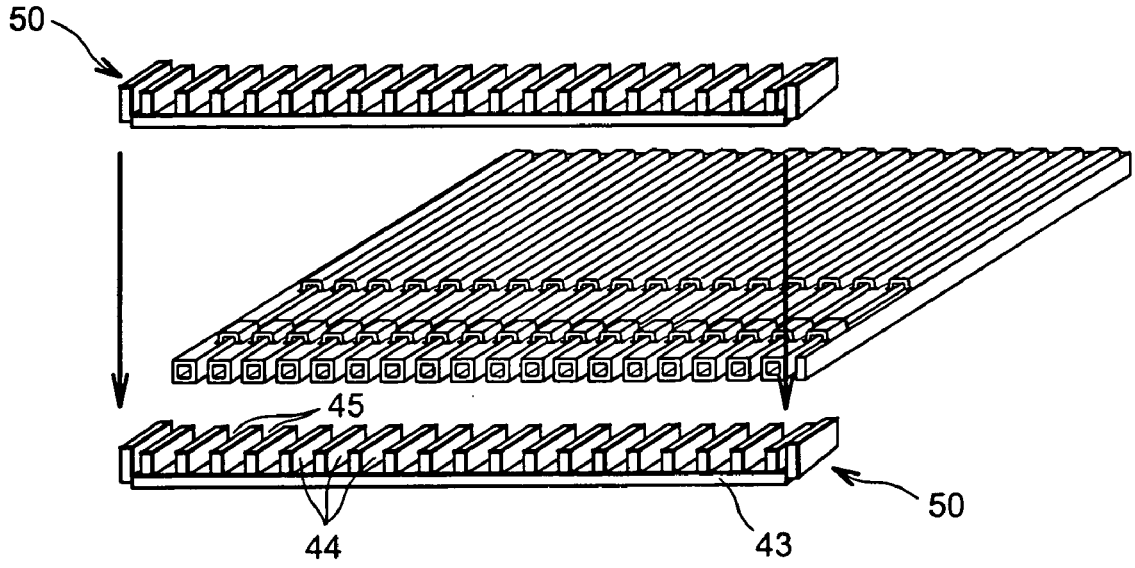
FIGS. 11 and 12 illustrate two other exchanger embodiments.

A construction to the frame 12 completely surrounding the plates 5 is not necessary to construct a heat exchanger. It is possible to use the end pieces, positioned solely on the longitudinal ends of the plates. As in the previous embodiment, it would be possible to stack and assemble parts of the same height as the plates 5. One of these parts, in the form of a comb, is represented in FIG. 11 with the reference 50. It is composed of a lower face 43 and teeth 44 raised on it. The pipes 8 of the second category again are adjusted in the serrations 45, matching those of the serrations 40, separating the teeth 44. The plate 5 is held in place by the lower face 43 of another end part 50 that is placed on the previous one and which will receive another plate 5.

Figure 12:
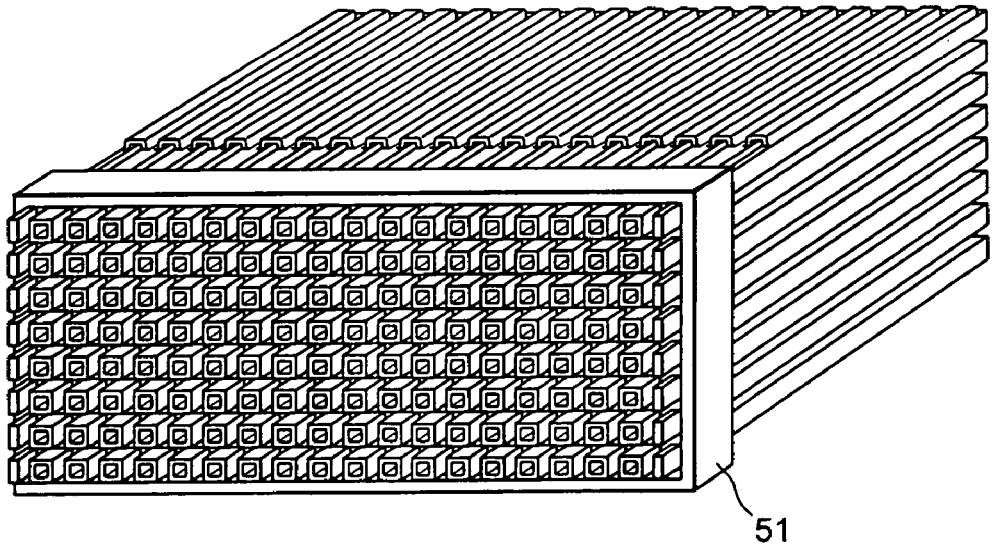

An end part 51 in the form of a perforated plate, through which pass the ends of the pipes 8 of the second category of the entire stack of plates 5, is illustrated in FIG. 12. This perforated plate 51 has a one piece structure from the beginning.

Identical distributors to the previous ones can communicate with the pipes 7 and 9 of the first and third category, even if the lateral sides of the plate stack 5 are not coated. The junctions of the plates 5 are brazed or glued, and no sealing material is required.

The invention may be applied to pipes whose hydraulic diameter of approximately 0.5 mm, with a low manufacturing cost.

The invention claimed is:

1. A heat exchanger plate, comprising an external envelope and walls dividing a volume limited by the envelope in pipes of a first category and of a second category of the envelope, the pipes of the first category and the pipes of the second category alternating across the plate in a transverse direction thereof, wherein the envelope of pipes has raised sections which protrude from two main faces of the plate, the raised sections and the pipes running in a same longitudinal direction, the first category of pipes extending in the raised sections exclusive of the second category of pipes, and wherein the raised sections and the envelope are notched on parts thereof in the longitudinal direction by opening the pipes of the first category.

2. The heat exchanger plate of claim 1, wherein the pipes of the first category have an oblong section.

3. The heat exchanger plate of claim 1, wherein the pipes have limiting surfaces grooved in the longitudinal direction.

4. The heat exchanger plate of claim 1, wherein the raised sections extend from two opposed faces of the envelope.

5. The heat exchanger plate of claim 1, wherein the heat exchange plate comprises a one piece structure, of uniform section and made by extrusion.

6. A heat exchanger comprising a plate stack limiting pipes, inlet and outlet fluid distributors, wherein at least one of the plates is according to claim 1, the distributors communicating with the pipes of the first category and with pipes of the second category, and wherein walls are provided, the pipes of the second category being separated from the pipes of the first category by said walls.

7. The heat exchanger of claim 6, which comprises a frame surrounding the plate stack, wherein the distributors comprise distributors communicating with the pipes of the first category and running along a first side of the frame and distributors communicating with a second category of pipes, running along a second side of the frame, the pipes of the second category being separated from the pipes of the first category by the walls, the first side and the second side of the frame comprising different sides.

8. The heat exchanger of claim 6, which comprises end pieces located at longitudinal ends the heat exchanger, the distributors comprising distributors communicating with the pipes of the first, category and running along a lateral side of the stack and distributors communicating with a second category of pipes and running along an end part, the pipes of the second category being separated from pipes of the first category by the walls, and the first side and the second side of the frame comprising different sides.

9. The heat exchanger of claim 7, wherein the frame comprises four sides it rectangular form, of which the first side and the second side are perpendicular to one another.

10. The heat exchanger of claim 7, which comprises an external envelope and raised sections with attached parts wherein the frame comprises elementary frames of the same height as the plates upon being stacked and unified, and comprising serrations on external housings cleared by the pipes of the second category and orifices positioned in front of the notched parts of the raised sections and the envelope.

* * * * *